US006802963B2

(12) United States Patent
Campbell

(10) Patent No.: US 6,802,963 B2
(45) Date of Patent: Oct. 12, 2004

(54) POOL CLEANER DEBRIS BAG

(75) Inventor: Sanford F. Campbell, Redding, CA (US)

(73) Assignee: Pentair Pool Products, Inc., Sanford, NC (US)

( * ) Notice: Subject to any disclaimer, the term of this patent is extended or adjusted under 35 U.S.C. 154(b) by 0 days.

(21) Appl. No.: 10/293,084

(22) Filed: Nov. 12, 2002

(65) Prior Publication Data

US 2004/0089593 A1 May 13, 2004

(51) Int. Cl.[7] ..... E04H 4/16; B01D 29/27

(52) U.S. Cl. ..... 210/169; 210/242.1; 210/416.2; 15/1.7

(58) Field of Search ..... 210/169, 242.1, 210/416.1, 416.2, 460; 15/1.7

(56) References Cited

U.S. PATENT DOCUMENTS

| | | | | | |
|---|---|---|---|---|---|
| 2,989,185 | A | * | 6/1961 | Lombardi | 210/776 |
| 4,040,864 | A | * | 8/1977 | Steeves | 134/6 |
| 4,746,424 | A | * | 5/1988 | Drew | 210/169 |
| 5,996,906 | A | * | 12/1999 | Cooper | 239/229 |
| 6,193,885 | B1 | * | 2/2001 | Campbell | 210/242.1 |
| 6,358,410 | B1 | * | 3/2002 | Lambert | 210/169 |

* cited by examiner

*Primary Examiner*—Fred G. Prince
(74) *Attorney, Agent, or Firm*—Vierra Magen Marcus Harmon & DeNiro LLP

(57) ABSTRACT

A pool cleaner debris bag includes a body having a debris collection cavity, an upper end and a lower end, the lower end coupled to the pool cleaner to receive debris from the pool ejected by the cleaner into the bag. The bag further includes a float positioned outside the debris collection region of the bag.

18 Claims, 10 Drawing Sheets

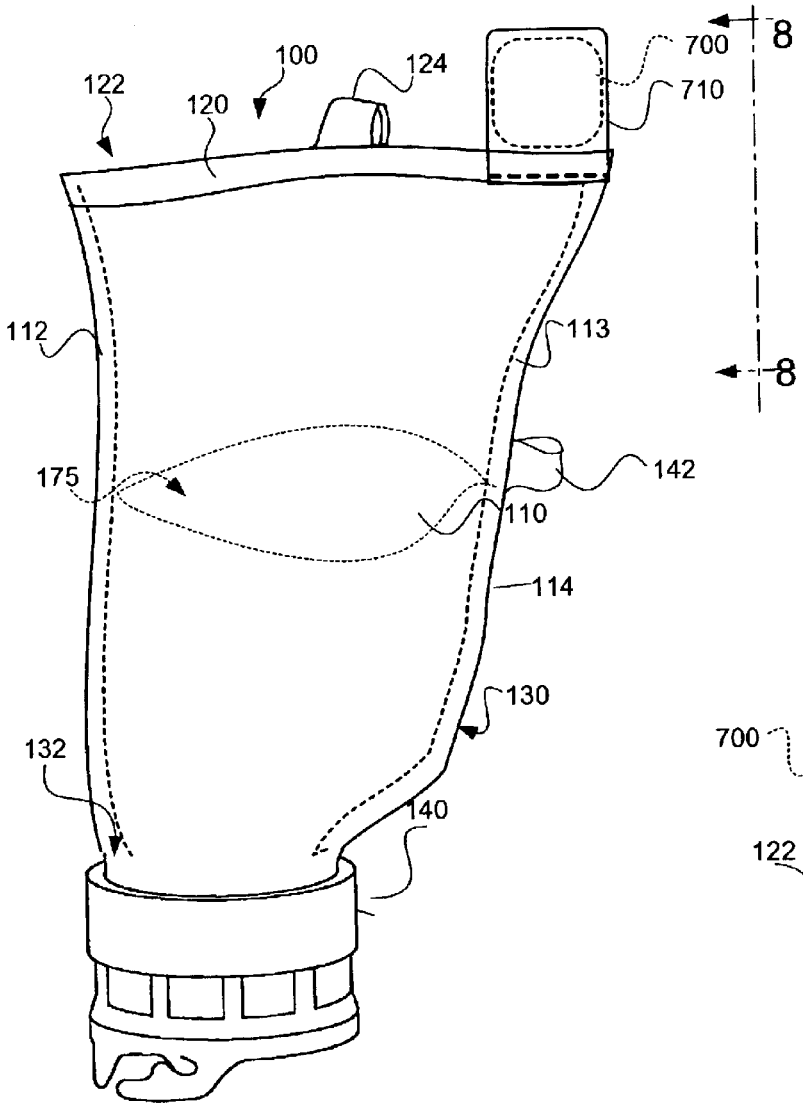
Figure 7
Figure 8
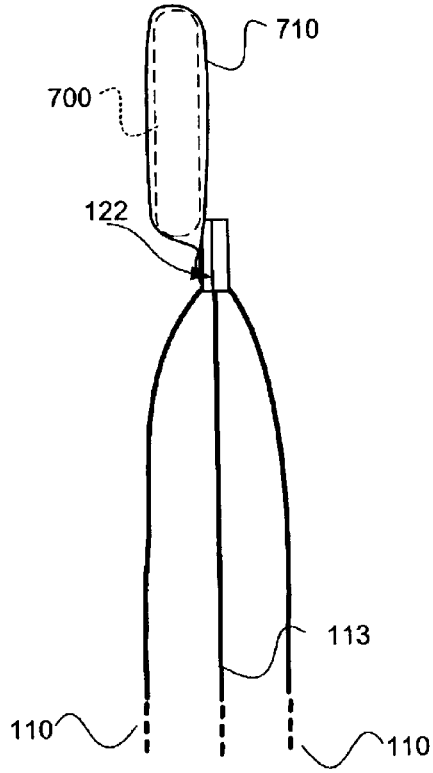

POOL CLEANER DEBRIS BAG

BACKGROUND OF THE INVENTION

1. Field of the Invention

This invention relates generally to the field of automatic swimming pool cleaners, and in particular to a bag designed to collect the refuse and debris from the pool cleaner during operation of the unit.

2. Description of the Related Art

Automatic swimming pool cleaners for cleaning the floor and sidewalls of a swimming pool are well known.

There are generally four types of pool cleaners in the pool cleaning market: pressure or return side cleaners; suction cleaners; electric cleaners and in-floor cleaners.

Pressure or return side cleaners use a debris bag to collect debris in the pool. Water from a pump is fed into the cleaner to sweep and collect debris into the bag carried by the cleaner. This means that the bag itself has a weight, buoyancy, and a weight factor that changes when debris is collected in the bag. The cleaner must be able to traverse the entire pool without being toppled. Weight is added to the bag when debris is collected in the bag, changing the weight of the bag as the cleaner moves in the pool. In addition, when empty the bag may topple over to one side, and various methods of attaching the bag to the water supply have heretofore been used to ensure the bag remains upright so as not to impair performance of the cleaner.

In a pressure cleaner, the influx of water into the cleaner affects the manner in which the cleaner acts under water. The buoyancy of objects is also a significant consideration in developing pressure cleaners and is affected by the component in the cleaner and the water inflow and action of the water within the cleaner.

One particular type of known automatic pressure cleaner having four wheels is shown and described in co-pending U.S. Pat. No. 5,893,188, and another three-wheel version in U.S. Pat. Nos. 3,822,754, 3,936,899, and 4,558,479.

FIG. 1 shows, by way of example, a first embodiment of an automatic swimming pool cleaner 10, such as that shown in U.S. Ser. No. 5,893,188, suitable for use with the present invention. Cleaner 10 includes a frame 12 on which a housing, consisting of an upper housing shell 14 and a lower housing shell 16, is mounted. An open suction mast 18 for vacuuming debris from beneath the cleaner 10 extends through an opening 20, generally in the middle of the upper housing shell 14, and a collection bag 22 is attached to the suction mast, over a flapper valve 24 positioned on the upper end of the suction mast, to collect the debris. A pair of opposing jets, located inside the suction mast 18 near its inlet at the bottom of the cleaner 10, induce a flow of water upwardly through the suction mast and into the collection bag 22 in well-known manner. When the cleaner 10 is operating, the force of the water pushes open the flapper valve 24; when the cleaner ceases operating, the flapper valve closes by virtue of gravity to keep the debris in the collection bag 22 from failing back into the swimming pool through the open suction mast 18.

Although not shown in FIG. 1, the bag 22 may be coupled to line 32 by a loop of material in order to keep the bag in the position generally shown in FIG. 1. Nevertheless, the bag may still have a tendency to flop over to one side or another. Accordingly, a need exists for an improved debris bag adapted for submerged travel in a pool with a pool cleaner. The present invention fulfills these and other needs.

Numerous improvements have been implemented in pool cleaner debris bags in order to make the use of the bag more efficient.

U.S. Pat. No. 6,193,885 discloses pool cleaner debris bag comprising a body having an upper end and a lower end, the lower end coupled to the pool cleaner to receive debris from the pool ejected by the cleaner into the bag, and a float positioned in the bag. This bag is suitable for many applications.

SUMMARY OF THE INVENTION

The present invention, roughly described, pertains to a pool cleaner debris bag. The bag includes a body including a debris collection cavity, the body having an upper end and a lower end, the lower end coupled to the pool cleaner to receive debris from the pool ejected by the cleaner into the bag. The bag further includes a float positioned outside the debris collection region of the bag.

The float may take many forms and be constructed of numerous types of material, such as foam, plastic, and the like.

Multiple floats may also be provided.

The invention improves on the prior art by providing a float which does not interfere with emptying debris from the debris bag.

BRIEF DESCRIPTION OF THE DRAWINGS

The invention will be described with respect to the particular embodiments thereof. Other objects, features, and advantages of the invention will become apparent with reference to the specification and drawings in which:

FIG. 7 is a perspective view of a yet another embodiment of the bag of the present invention.

FIG. 8 is a cross-section along line 8—8 in FIG. 7 of a first alternative arrangement of the float of FIG. 7.

DETAILED DESCRIPTION

Figure 2:
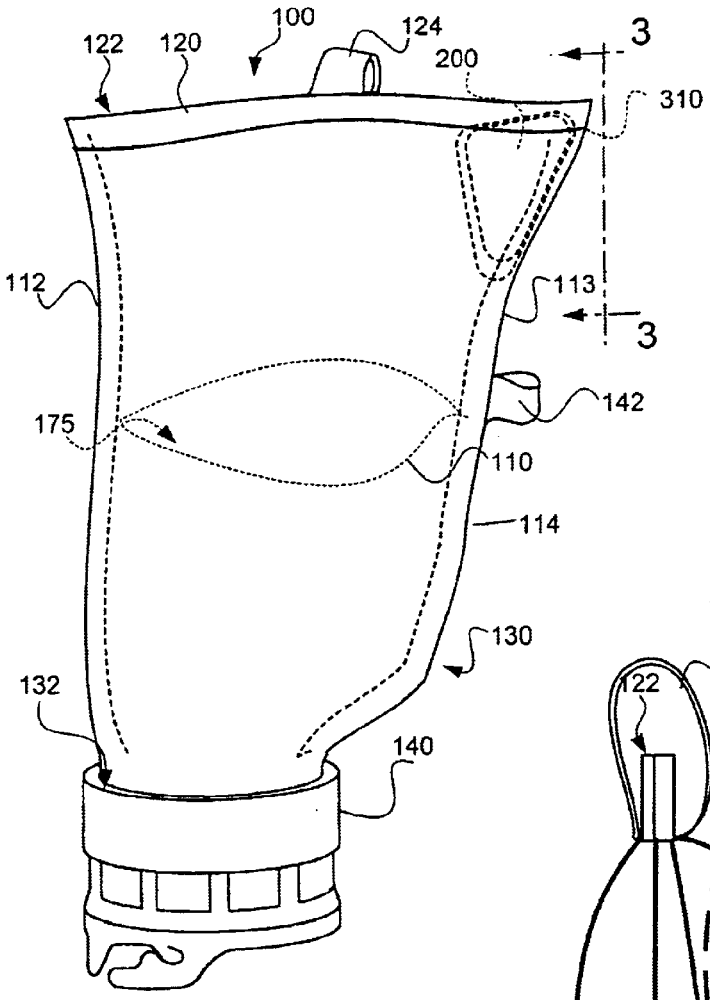
FIG. 2 is a perspective view of an embodiment of the bag of the present invention.

FIG. 2 shows a perspective view of a first alternative embodiment of the present invention. Bag 100 is substantially constructed of a porous material 110 which is chosen such that it is sufficiently porous to allow water or other liquid to pass therethrough relatively easily, while restricting the flow of most debris collected by pool sweeps and pool cleaners. The main portion of pool sweep bag 100 is constructed of a single piece of porous material 110 which is folded along the left side 112 and seamed and sewn together to form a vertical form 113 along right side 114. It should be noted that vertical seam 114 could be constructed to allow opening or closing thereof, however in this embodiment, vertical seam 114 is sewn and horizontal seam 120 constructed with velcro closures to allow opening thereof to remove debris.

Figure 1:
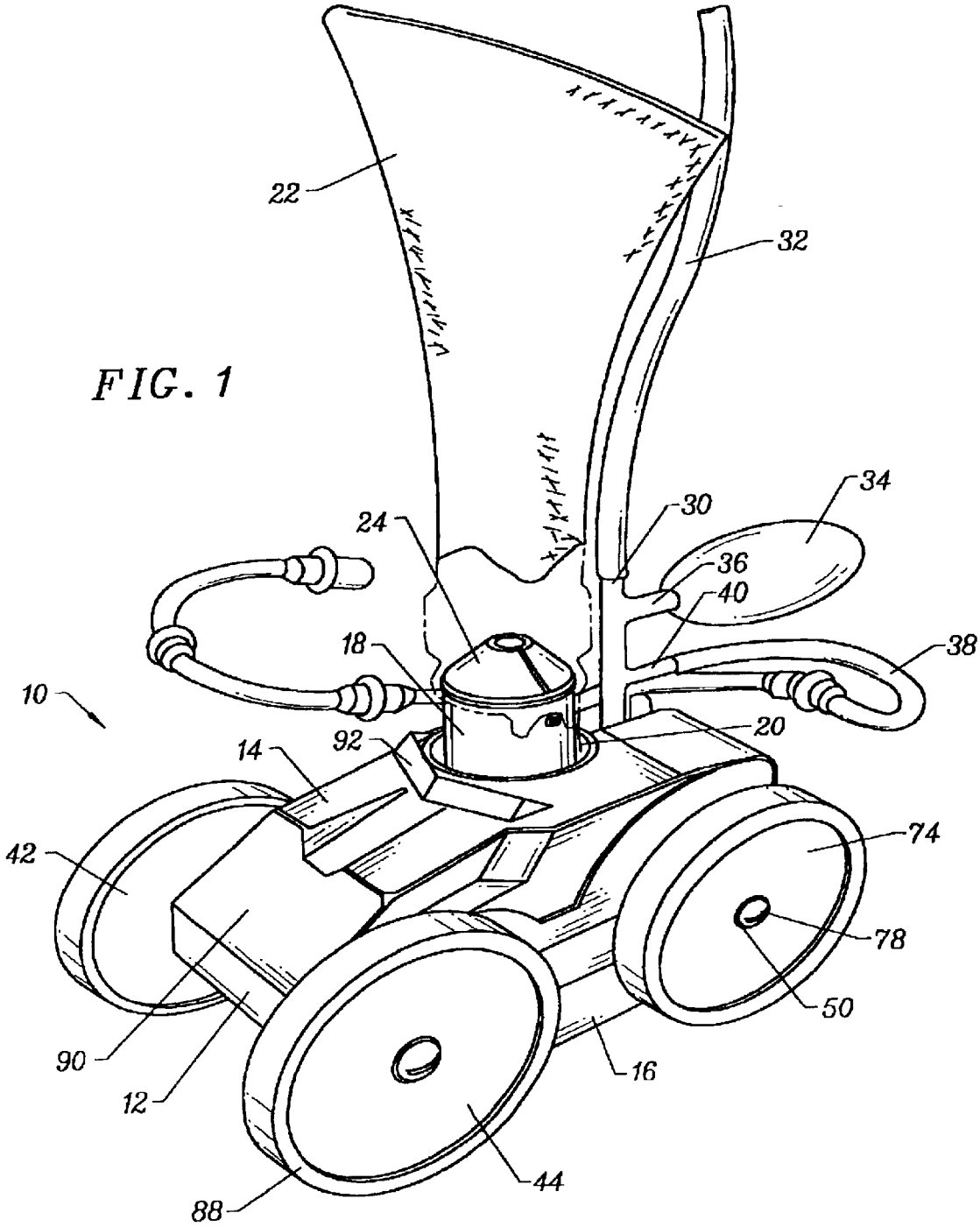
FIG. 1 is a perspective view of a first embodiment of an automatic swimming pool cleaner of the present invention, with a portion of the collection bag shown in phantom for purposes of illustration.

Seam 120 is positioned at a top portion 122 of pool bag 100. Seam 120 is constructed by utilizing a velcro hook-type material or equivalent and a velcro loop-like material or equivalent to facilitate opening and closing thereof. Top portion 120 includes a strap 124 positioned to allow an individual to remove bag 100 from the pool sweep or cleaner by simply inserting a finger through the strap 124 and lifting. At bottom portion 130, a snout portion 132 is provided. A bottom sea, not shown in FIG. 2. is constructed of a folded, sewn layer of the porous material. In FIG. 2, snout portion is shown as mounted in a coupling 140 to allow bag 100 to be easily coupled to and decoupled from the pool sweep or pool cleaner. Bag 100 may optionally include a second loop 142 to allow the bag to be coupled to the feed hose 32 of the cleaner such as that shown in FIG. 1.

When constructed as described above, the bag includes an interior debris collection region 175 defined by the material, seams, top portion and side portions. Debris is fed from the cleaner into the interior debris collection region via the coupling.

Also shown in FIG. 2, and in accordance with a first embodiment of the present invention, is a float unit 200 secured adjacent to the top portion 120 and right side 114 of bag 100.

Float 150 may be comprised of any suitably buoyant material, or constructed as rubber or plastic, molded, sealed or otherwise joined or constructed, air-filled float. In one embodiment, a particularly desirable float material comprises a closed-cell foam material which has a buoyancy sufficient to support bag 100 under water in pool cleaning applications.

Innumerable materials may be utilized as the float material of float 150. A closed-cell material is desirable since it can be punctured without loosing buoyancy, allowing easy use of a securing strap piercing the float without generally affecting the buoyancy of float 150. However, any number of suitable buoyant materials may be utilized so long as the buoyancy is sufficient to support the weight of the bag under water. Moreover, the size of the float may vary in accordance with the particular application, and again is easily empirically determined. All such various embodiments are contemplated as being within the scope of the present invention.

Figure 3A:
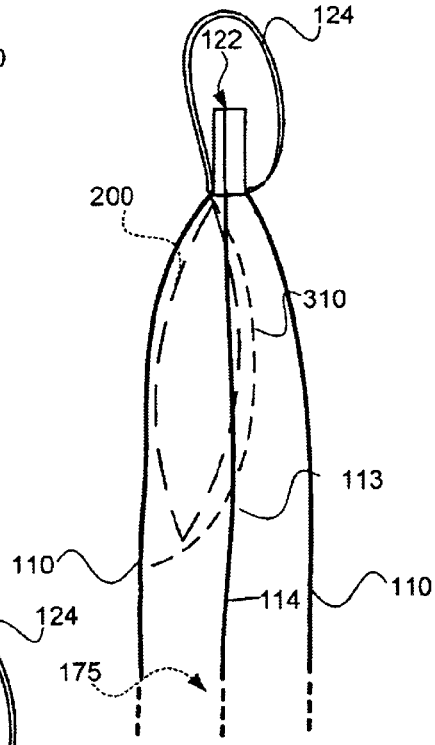
FIG. 3A is a cross-section along line 3—3 in FIG. 2 of a first alternative arrangement of the float of FIG. 2.
Figure 3B:
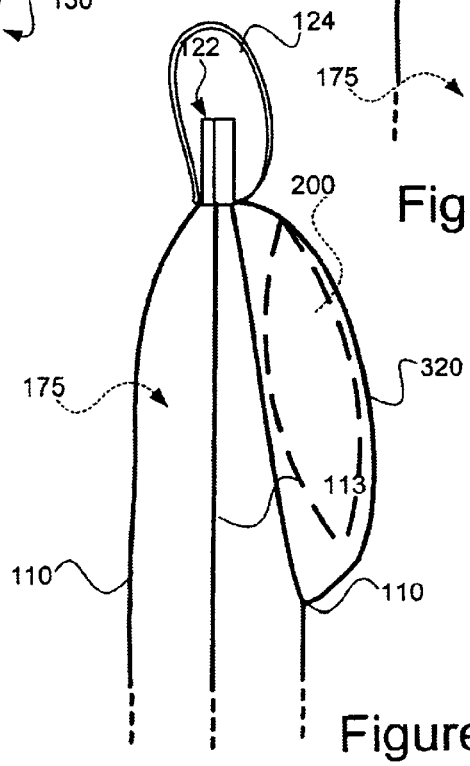
FIG. 3B is a cross-section along line 3—3 in FIG. 2 of a second alternative arrangement of the float of FIG. 2.

FIGS. 3A and 3B show two alternatives for securing the float to bag 100. In FIG. 3A, an interior porous material sack 310 is sewn into the bag and the float 200 secured within the sack 310. In FIG. 3B a porous material sack 320 is sewn to the outside of bag 100. It should be recognized that a further alternative embodiment is to make sack 310 or 320 two sided, and constructed out of a watertight material containing a pocket with air or another buoyant material, and sew or otherwise attach the sack itself, (without a separate float) to the outside or inside of bag 100. It should be recognized that while the float is shown in FIG. 2 as being on the right portion of the bag 114, the float could be positioned on the left side of the bag 112 as well.

In alternative embodiments, the float may be positioned at alternative locations in the bag, depending on the shape of the bag and construction of the cleaner. It should be recognized that it would be relatively easy to empirically determine optimal placement of the float in the bag depending upon the shape of the bag, the shape and size of the float, and the manner in which the bag is coupled to the cleaner.

Figure 4:
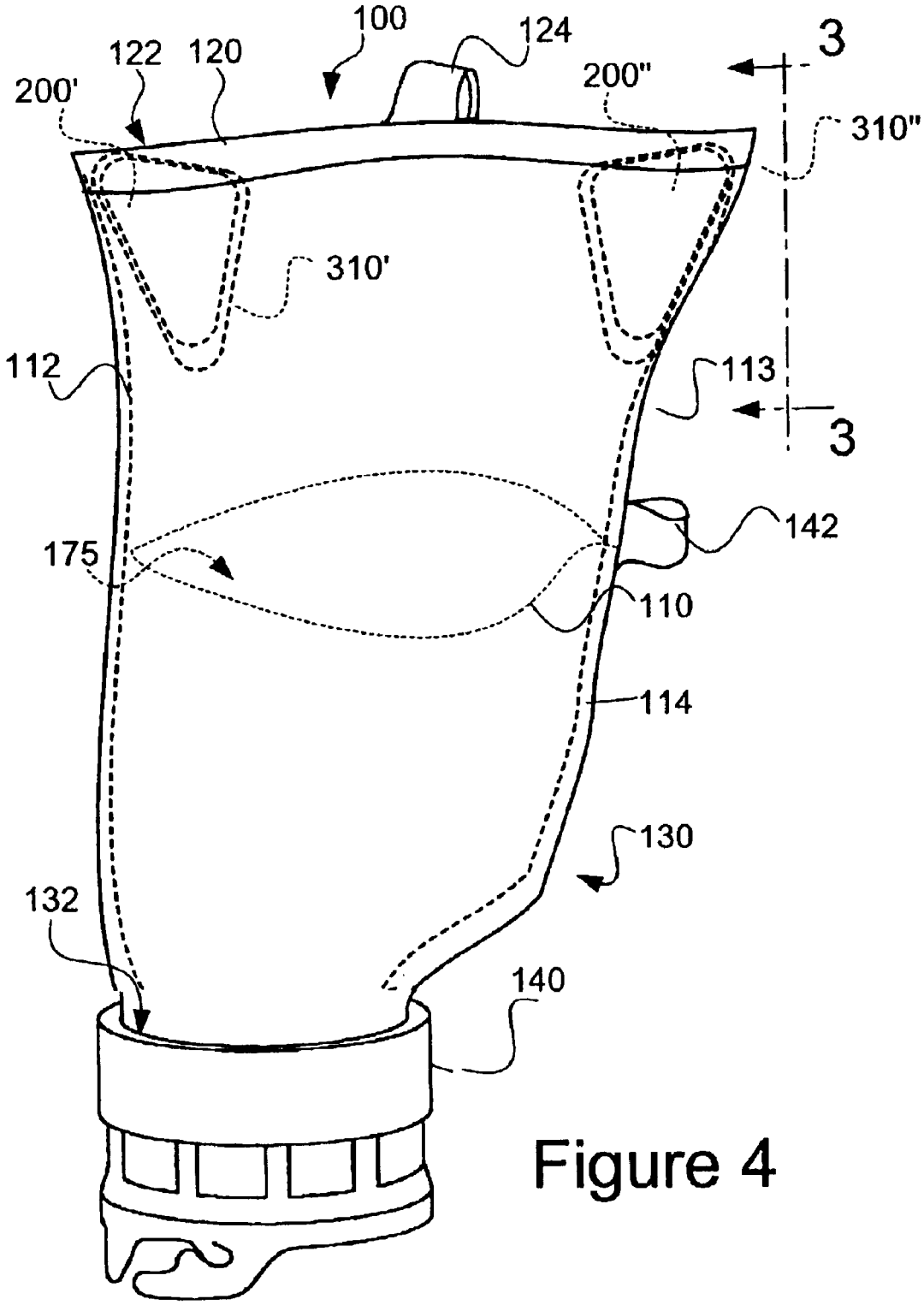
FIG. 4 is a perspective view of another embodiment of the bag of the present invention.

FIG. 4 shows an alternative embodiment of the invention wherein two floats 200' and 200" are used in bag 100.

Figure 5:
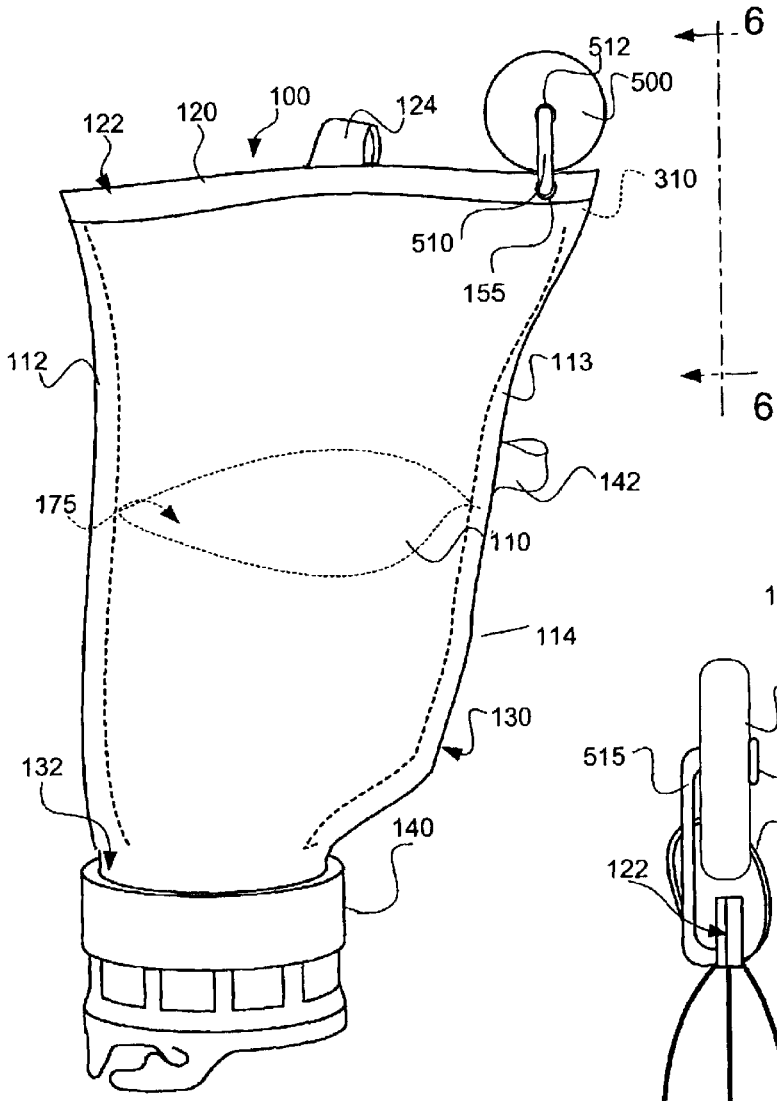
FIG. 5 is a perspective view of a further embodiment of the bag of the present invention.

FIG. 5 shows another embodiment of an externally mounted float 500. In this embodiment, the float is shown as circular in cross-section as illustrated in FIG. 5; however it should be understood that the particular cross-section of the float shape is not important to the nature of the invention.

Figure 6A:
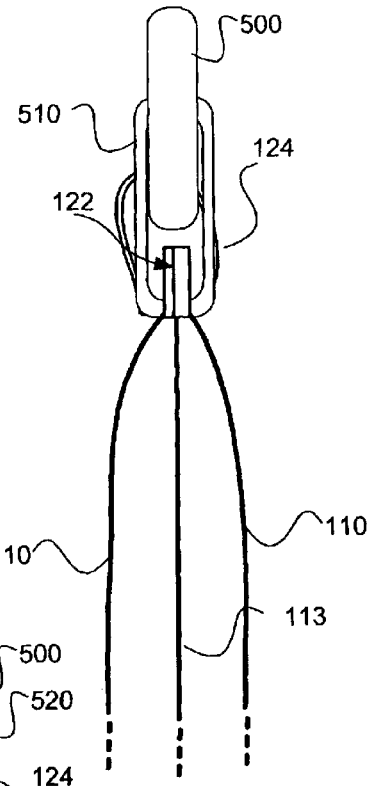
FIG. 6A is a cross-section along line 6—6 in FIG. 5 of a first alternative arrangement of the float of FIG. 5.

As shown in FIGS. 5 and 6, float 500 secured to the bag 100 by a strap attachment 510. In FIG. 6A, attachment 510 is shown as looping through a hole 512 in float 500. Attachment 510 may be plastic, rubber, string, rope, nylon, synthetic fiber, natural fiber, wire, polypropylene, kelvar, or any suitably strong material. The attachment may be secured through a re-enforced hole 155 in bag 100.

Figure 6B:
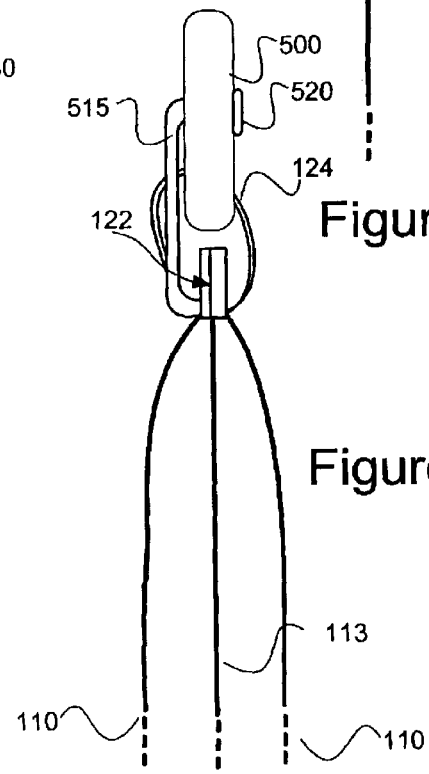
FIG. 6B is a cross-section along line 6—6 in FIG. 5 of a second alternative arrangement of the float of FIG. 5.

In the alternative embodiment shown in FIG. 6B, the attachment includes a securing portion 520 which may be molded or formed to prevent float 500 from leaving the attachment, requiring only a single sided attachment 515 passing through hole 155.

Figure 9:
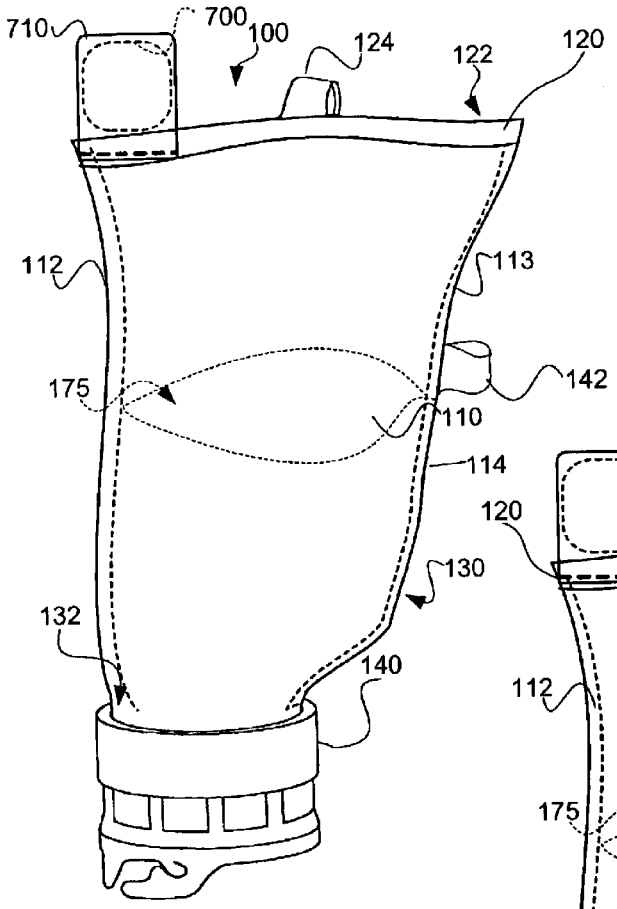
FIG. 9 is a perspective view of a further embodiment of the bag of the present invention.

FIG. 7 shows another alternative embodiment wherein a float 500 is positioned outside the debris collection region of the bag. In FIG. 7, a float 700 is positioned in an attachment bag 710 formed of the same porous material as the bag 100. The attachment bag 710 may be sewn, glued or otherwise attached to the upper portion of the bag 100. While shown on the right side of the bag 100 in FIG. 7, the float could be positioned on the left side 112 (as shown in FIG. 9) or at any position between the right and left sides.

FIGS. 7 and 8 show a square float formed in the manner as those set forth in the prior embodiments, but it should be recognized that any shaped float is within contemplation of the principles of the invention.

Figure 10:
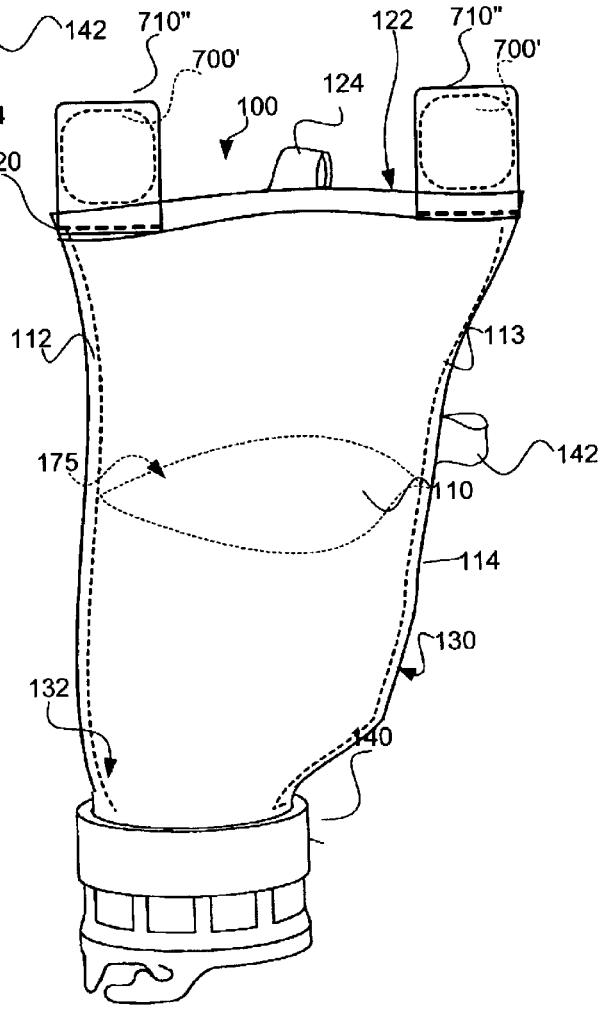
FIG. 10 is a perspective view of an additional embodiment of the bag of the present invention.

Yet another alternative is shown in FIG. 10 wherein two floats 700' and 700" are used on bag 100. The floats 700' and 700" are positioned in attachment bags 710' and 710".

Figure 11:
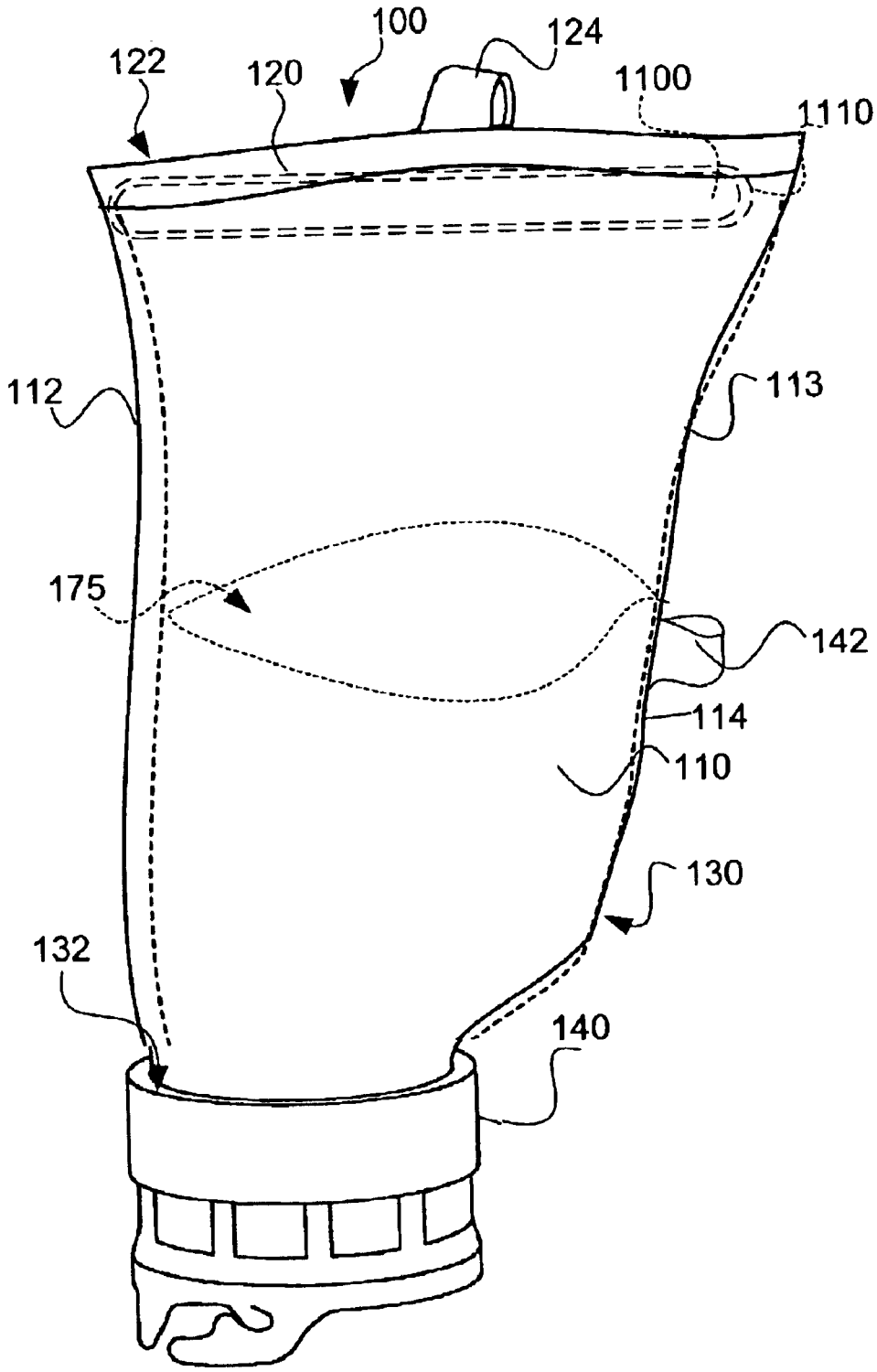
FIG. 11 is a perspective view of a still further embodiment of the bag of the present invention.

FIG. 11 shows an elongated float 1100 positioned in an attachment sack 1110 as provided in the embodiments shown in FIGS. 3A and 3B. The elongated float increases the area available for air or another buoyant material within the float, and thereby the buoyancy of the float and the bag. It will be apparent to one of average skill in the art that any number of different shapes and sizes of floats may be used depending on the quantity and location of the buoyancy desired.

Figure 12:
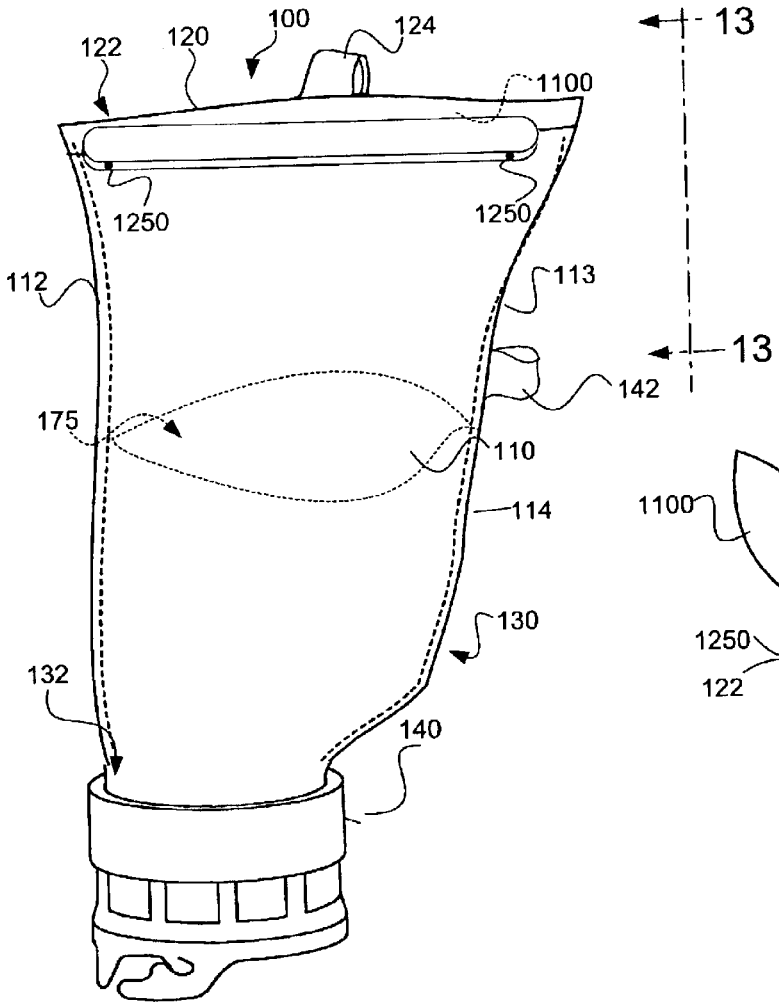
FIG. 12 is a perspective view of another embodiment of the bag of the present invention.
Figure 13:
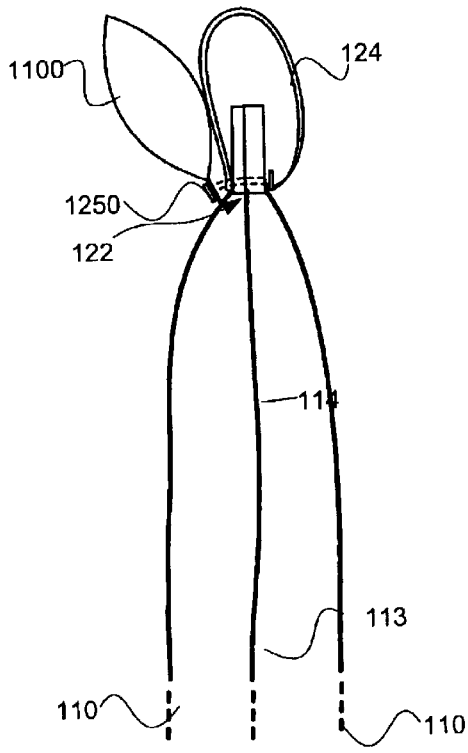
FIG. 13 is a cross-section along line 13—13 in FIG. 13 of an arrangement of the float of FIG. 12.

FIG. 12 shows another alternative embodiment of the present invention where an elongated float similar to that shown in FIG. 12 is positioned on the exterior of the bag 100. Float 1100 may be attached at its base by directly attaching the float to the bag at one or more points using a connector 1250 made of plastic, rubber, wire, nylon or other suitable material, as shown in FIG. 13, or may be provided in a exterior attachment sack such as that shown in FIG. 8.

Figure 14:
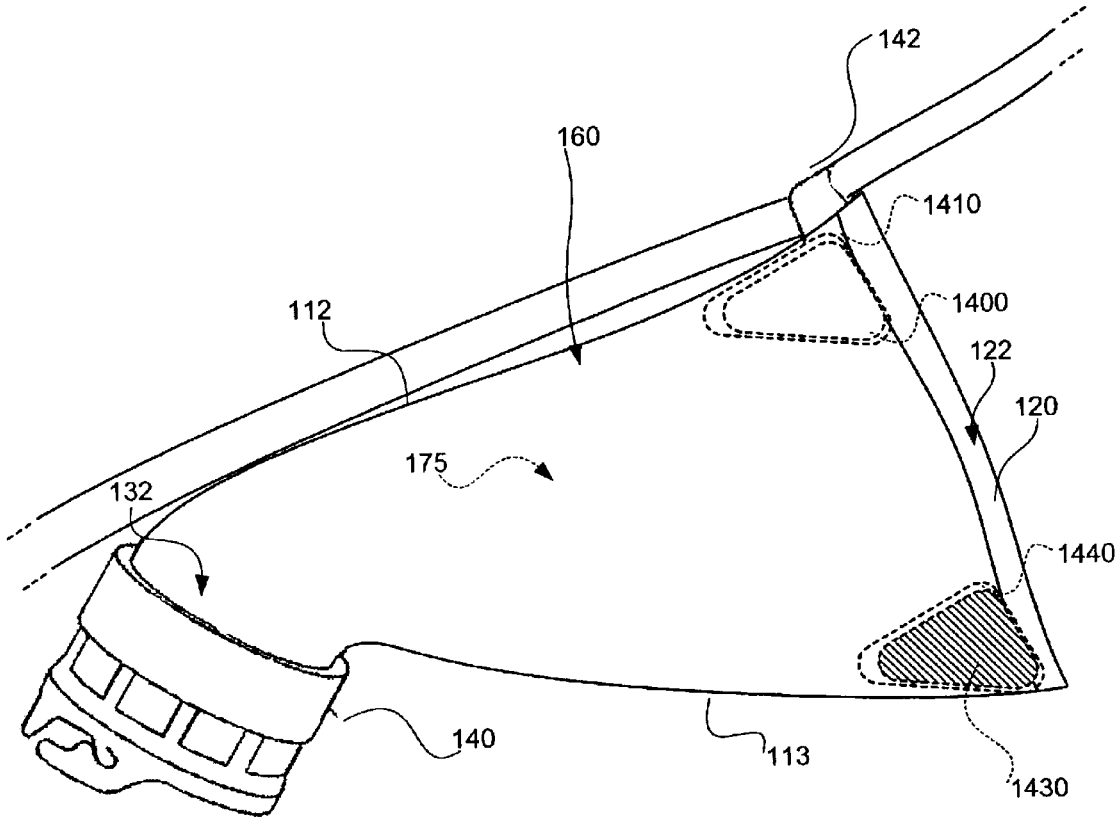
FIG. 14 is a perspective view of a first side bag embodiment of the bag of the present invention.

FIG. 14 shows a side mounted bag 160 having a hose attachment positioned at the top portion of the bag. The bag is designed to be carried sideways (so that the top portion 122 is generally perpendicular rather than parallel to the pool floor during operation). In this embodiment, a float 1400 is positioned at a first side of the bag in a attachment sack 1410 and a weight 1430 is positioned in a second portion in a second sack 1440. The weight 1430 and float 1400 maintain the orientation of the bag so the bag does not become twisted about the coupling.

Figure 15:
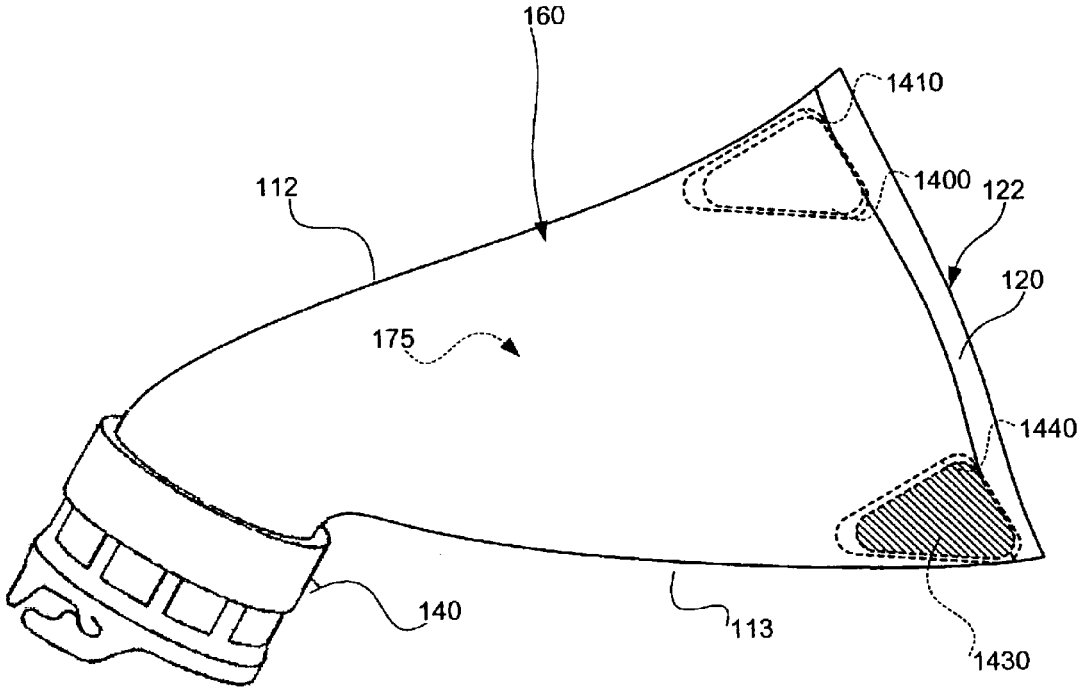
FIG. 15 is a perspective view of a second side bag embodiment of the bag of the present invention.

The embodiment of FIG. 15 includes a bag with no hose attachment. The weight 1430 and float 1400 combination is particularly useful in this arrangement wherein the hose is not used to stabilize one part of the bag 160. Such a bag may be used with cleaners which are powered by electricity or other means and no feeder hose is used, as in pressure cleaners like that shown in FIG. 1.

The foregoing detailed description of the invention has been presented for purposes of illustration and description. It is not intended to be exhaustive or to limit the invention to the precise form disclosed. Many modifications and variations are possible in light of the above teaching.

One modification concerns the shape of the float. In the present description, floats having a triangular, square, rectangular and oblong shape are shown. The shape of the float is not germane to the scope of the present invention in that any shape of float is considered to be within the scope of the present invention. Another modification is the number and position of the float. Yet another is the composition of and relative buoyancy of each float.

The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A pool cleaner debris bag comprising:

a body including a debris collection cavity, the body having an upper end and a lower end, the lower end coupled to the pool cleaner to receive debris from the pool ejected by the cleaner into the bag; and a float coupled to the body positioned outside of and adjacent to the debris collection region of the bag separate from the lower end.

2. The debris bag of claim 1 further including a second float positioned outside the debris collection region.

3. The debris bag of claim 1 wherein said float has a buoyancy sufficient to support the weight of the bag in water.

4. The debris bag of claim 1 wherein the float is comprised of a foam.

5. The debris bag of claim 1 wherein the float is comprised of a molded single cell float.

6. The debris bag of claim 1 wherein the float is comprised of a buoyant solid material.

7. The debris bag of claim 1 wherein the float is coupled to the bag by means of attachment sack sewn to the outside of the bag.

8. A debris bag for a pool cleaner having a top end and a second end, comprising:

a body having a debris inlet opening to a collection cavity and being coupled to the cleaner at the inlet; and a float coupled to the body at a position outside of and adjacent to the collection cavity and separate from the inlet opening.

9. The debris bag of claim 8 wherein the body has a top end and a bottom end, a left end and a right end, a top seam, and the float is positioned at the top seam.

10. The debris bag of claim 8 wherein the float is secured to the bag by an external connector.

11. The debris bag of claim 8 wherein the float is contained in an external porous material housing.

12. The debris bag of claim 11 wherein the porous material housing is sewn to the bag.

13. The debris bag of claim 8 wherein the float comprises a water-tight material sewn to the bag.

14. The debris bag of claim 8 wherein the float has a triangular cross-section.

15. The debris bag of claim 8 wherein the float has a circular cross-section.

16. The debris bag of claim 8 further including a second float attached outside the cavity.

17. The debris bag of claim 8 further including a weight positioned at a lower portion of the bag relative to the float.

18. A pool cleaner debris bag comprising:

a porous material defining an interior cavity having a closable top end and an open bottom end, the bottom end coupled to the pool cleaner to receive debris from the pool ejected by the cleaner into the bag;

a coupling connecting the bottom end to the cleaner;

a float disposed outside the interior cavity of the bag proximate the closable top end; and means joined to the top end for securing the float to the closable top end.

* * * * *